US011830337B2

(12) United States Patent
Yeon Lim

(10) Patent No.: US 11,830,337 B2
(45) Date of Patent: Nov. 28, 2023

(54) SIGNAL DEVICE FOR MARITIME DISTRESS RESCUE AND SURVEILANCE DEVICE FOR MARITIME DISTRESS RESCUE

(71) Applicant: STORYFORYOU CO., LTD, Suwon-si (KR)

(72) Inventor: Hee Yeon Lim, Suwon-si (KR)

( * ) Notice: Subject to any disclaimer, the term of this patent is extended or adjusted under 35 U.S.C. 154(b) by 0 days.

(21) Appl. No.: 17/933,490

(22) Filed: Sep. 20, 2022

(65) Prior Publication Data

US 2023/0011440 A1 Jan. 12, 2023

Related U.S. Application Data

(62) Division of application No. 16/482,268, filed on Jul. 31, 2019, now Pat. No. 11,488,462.

(30) Foreign Application Priority Data

Aug. 29, 2018 (KR) ..... 10-2018-0101748
May 28, 2019 (WO) ..... PCT/KR2019/006351

(51) Int. Cl.
*B63C 9/00* (2006.01)
*G08B 21/08* (2006.01)
*B63C 9/08* (2006.01)

(52) U.S. Cl.
CPC ..... *G08B 21/088* (2013.01); *B63C 9/0005* (2013.01); *B63C 9/08* (2013.01); *B63C 2009/0017* (2013.01)

(58) Field of Classification Search
CPC ..... G08B 21/088; B63C 9/0005; B63C 2009/0017
See application file for complete search history.

(56) References Cited

U.S. PATENT DOCUMENTS

2008/0062816 A1* 3/2008 Leal ..... G01S 5/28 367/93
2021/0190970 A1* 6/2021 Edwards ..... H04B 17/318

* cited by examiner

*Primary Examiner* — Benyam Haile
(74) *Attorney, Agent, or Firm* — Patshegen IP; Moshe Pinchas

(57) ABSTRACT

A signal device for maritime distress rescue and a surveillance device for maritime distress rescue are provided. The signal device for maritime distress rescue which is carried by a user aboard a vessel may include a first communicator configured to communicate with a surveillance device for maritime distress rescue of the vessel, a first position detector configured to generate first position information of the signal device at a predetermined time interval, and a first controller configured to receive second position information of the surveillance device from the surveillance device at a predetermined time interval and determine whether the first position information is within a safe area of the vessel that is set on the basis of the second position information. Accordingly, when a distress occurs, it is possible to transmit a distress signal without operating a switch while minimizing power consumption of the signal device.

2 Claims, 9 Drawing Sheets

SIGNAL DEVICE FOR MARITIME DISTRESS RESCUE AND SURVEILANCE DEVICE FOR MARITIME DISTRESS RESCUE

CROSS-REFERENCE TO RELATED APPLICATION(S)

This application is a Divisional of commonly owned U.S. patent application Ser. No. 16/482,268, entitled: SIGNAL DEVICE FOR MARITIME DISTRESS RESCUE AND SURVEILLANCE DEVICE FOR MARITIME DISTRESS RESCUE, filed on Jul. 31, 2019, the disclosure of which is incorporated by reference herein.

BACKGROUND

1. Field

The following description relates to a signal device for maritime distress rescue and surveillance device for maritime distress rescue, and more particularly, to a technology for automatically determining a distress at sea and transmitting a distress signal.

2. Description of Related Art

V-pass, which can transmit a distress signal in the event of a marine accident, is installed in a fishing vessel and VHF-DSC radio is mandatorily installed. However, when a fishing vessel overturns or sinks, the above communication equipment loses communication and only inform of final sinking point of the vessel, and there is no way to confirm the location of a person in distress drifting with the sea currents. In addition, since a distance range of communication with a land communication station is limited, it may be difficult to even report an accident when a fishing operation is performed in the far sea.

The reason the overturn or sinking of a fishing vessel leads to marine casualties is that it is difficult to visually locate a person in distress drifting away by fast sea currents. At night time when a field of vision is decreased or in case of a poor weather condition, such as fog, search may be more difficult and lead to hypothermic accidents or disappearances of persons in distress. In the case of accidents of other vessels, in addition to fishing vessels, or maritime distresses during marine leisure activities, especially at night, a range of a searchlight is as short as a few hundred meters and it is difficult to locate a person in distress due to poor weather conditions or sea currents. Accordingly, a rate of a drowning accident rescue is very low or search of missing persons is very difficult.

As one of the prior arts, Korean patent registration No. 10-0716518 (published on May 9, 2007) relates to a wireless distress signal device with global positioning system (GPS) and a wireless rescue system thereof. However, the aforementioned prior art has a problem in that malfunction occurs since it cannot accurately identify a situation, such as a rainfall situation or a watery situation, caused by various environmental factors. In addition, it is practically impossible to find and operate a button to transmit an emergency signal in a situation where a user is in the water, and hence there is a limit to utilize such prior art in the rescue of human lives.

SUMMARY

This summary is provided to introduce a selection of concepts in a simplified form that are further described below in the Detailed Description. This summary is not intended to identify key features or essential features of the claimed subject matter, nor is it intended to be used as an aid in determining the scope of the claimed subject matter.

One objective of the present invention is to provide a signal device for maritime distress rescue and a surveillance device for maritime distress rescue which are capable of transmitting precise location of a person in distress using GPS data and issue an alarm notification by accurately detecting a distress situation of a mariner aboard a vessel, without requiring an operation of a flooding detection sensor or a switch, while minimizing power consumption of the signal device supplied with power from a battery, so that a rescue operation can be swiftly carried out.

In addition, another objective of the present invention is to provide a signal device for maritime distress rescue and a surveillance device for maritime distress rescue which are capable of more accurately determining whether a distress occurs by utilizing digital data of height information or speed information.

Also, still another objective of the present invention is to provide a signal device for maritime distress rescue and a surveillance device for maritime distress rescue which predict a location of a person in distress and transmit the location to a user terminal so that a rescue can be swiftly carried out with the help of any vessels or authorities near the person in distress.

In one general aspect, there is provided a signal device for maritime distress rescue which is carried by a user aboard a vessel, the signal device including a first communicator configured to communicate with a surveillance device for maritime distress rescue of the vessel, a first position detector configured to generate first position information of the signal device at a predetermined time interval, and a first controller configured to receive second position information of the surveillance device from the surveillance device at a predetermined time interval and determine whether the first position information is within a safe area of the vessel that is set on the basis of the second position information.

The first controller may control the first communicator to wait in reception mode or sleep mode when the first position information is within the safe area, and switch the first communicator to high-power transmission mode to output a distress signal to the surveillance device when the first position information is out of the safe area.

When the vessel is stationary, the first controller may re-set the safe area using GPS coordinates and heading information, which is azimuth of the vessel, in the second position information, and, when the vessel is moving, may re-set the safe area using at least one of the GPS coordinates, moving direction, moving speed, and communication delay time in the second position information and determine whether the first position information is within the safe area.

The first controller may output a distress signal to the surveillance device when a speed difference or height difference between the first position information and the second position information exceeds a predetermined value.

In another general aspect, there is provided a surveillance device for maritime distress rescue which is mounted in a vessel, the surveillance device including a second communicator configured to communicate a signal device for maritime distress rescue which is carried by a user aboard the vessel, a second position detector configured to generate second position information including current GPS coordinates of the surveillance device and heading information of the vessel at a predetermined time interval, and a second controller configured to transmit the second position information to the signal device at a predetermined time interval and determine whether a distress signal is received from the signal device, wherein the distress signal is transmitted only when it is determined that first position information of the signal device is out of a safe area which is set on the basis of the second position information.

When the vessel is stationary, the second position detector may generate the second position information including the GPS coordinates of the surveillance device and heading information, which is azimuth of the vessel, and, when the vessel is moving, may generate the second position information including at least one of the GPS coordinates, moving direction, and moving speed of the surveillance device.

When the distress signal is received, the second controller may display on a display whether a plurality of users aboard the vessel are in distress, wherein whether the plurality of users aboard the vessel are in distress is displayed in map mode in which the first position information and the second position information are mapped on an electronic map, or in compass mode in which a distance and azimuth between the signal device and the surveillance device are displayed.

Other features and aspects will be apparent from the following detailed description, the drawings, and the claims.

Figure 1:
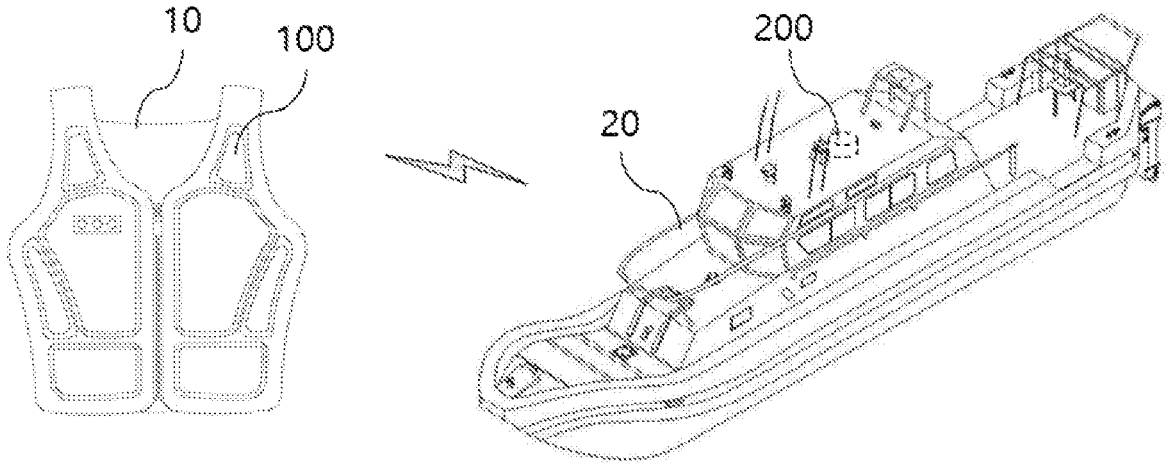
FIG. 1 is a diagram illustrating a configuration of a maritime distress rescue system.

Throughout the drawings and the detailed description, unless otherwise described, the same drawing reference numerals will be understood to refer to the same elements, features, and structures. The relative size and depiction of these elements may be exaggerated for clarity, illustration, and convenience.

DETAILED DESCRIPTION

Hereinafter, in order to facilitate understanding and reproduce by those skilled in the art, the present invention will be described in detail by explaining exemplary embodiments with reference to the accompanying drawings. Terms described in below are selected by considering functions in the embodiment and meanings may vary depending on, for example, a user or operator's intentions or customs. Therefore, in the following embodiments, when terms are specifically defined, the meanings of terms should be interpreted based on definitions, and otherwise, should be interpreted based on general meanings recognized by those skilled in the art.

FIG. 1 is a diagram illustrating a configuration of a maritime distress rescue system.

Referring to FIG. 1, the maritime distress rescue system may include a signal device 100 for maritime distress rescue and a surveillance device 200 for maritime distress rescue.

The signal device 100 for maritime distress rescue is a device configured to communicate with the surveillance device 200 for maritime distress rescue and output a rescue signal. The signal device 100 may be embedded in a lifejacket 10 or may be implemented as a wearable type (e.g., necklace, bracelet, or the like) that a user can wear. The signal device 100 may have a battery embedded therein. When necessary, a power source may be charged using a solar cell. The signal device 100 may be operated in a reception mode, a sleep mode, or a transmission mode by communicating with the surveillance device 200. A unique ID may be assigned to the signal device 100, and IDs may be exchanged during communication. The signal device 100 may further include a means capable of outputting an alarm sound or an alarm message if necessary.

The surveillance device 200 for maritime distress rescue is installed in a vessel 20 and communicates with the signal device 100 for maritime distress rescue. In this case, the surveillance device 200 may communicate with the signal device 100 using a radio frequency (RF) communication method, but is not limited thereto. The surveillance device 200 may be fixedly or movably mounted in the vessel 20. The surveillance device 200 uses a global positioning system (GPS) to generate position information and moving direction information, such as a moving speed and heading information related to a moving direction of the vessel, and transmits the generated information to the signal device 100.

When the surveillance device 200 receives a distress signal from the signal device 100, the surveillance device 200 may track a current location of a person in distress using the distress signal, thereby allowing for prompt rescue. The surveillance device 200 may be interlocked with a monitoring device, such as a personal computer, or a smartphone for distress notification and position tracking. In this case, an application connected to the surveillance device 200 is installed in the PC and the smartphone. The surveillance device 200 may be connected to a device, such as a display or a speaker, to output an alarm message or an alarm sound when receiving the distress signal, thereby immediately informing the user of the distress situation.

Figure 2:
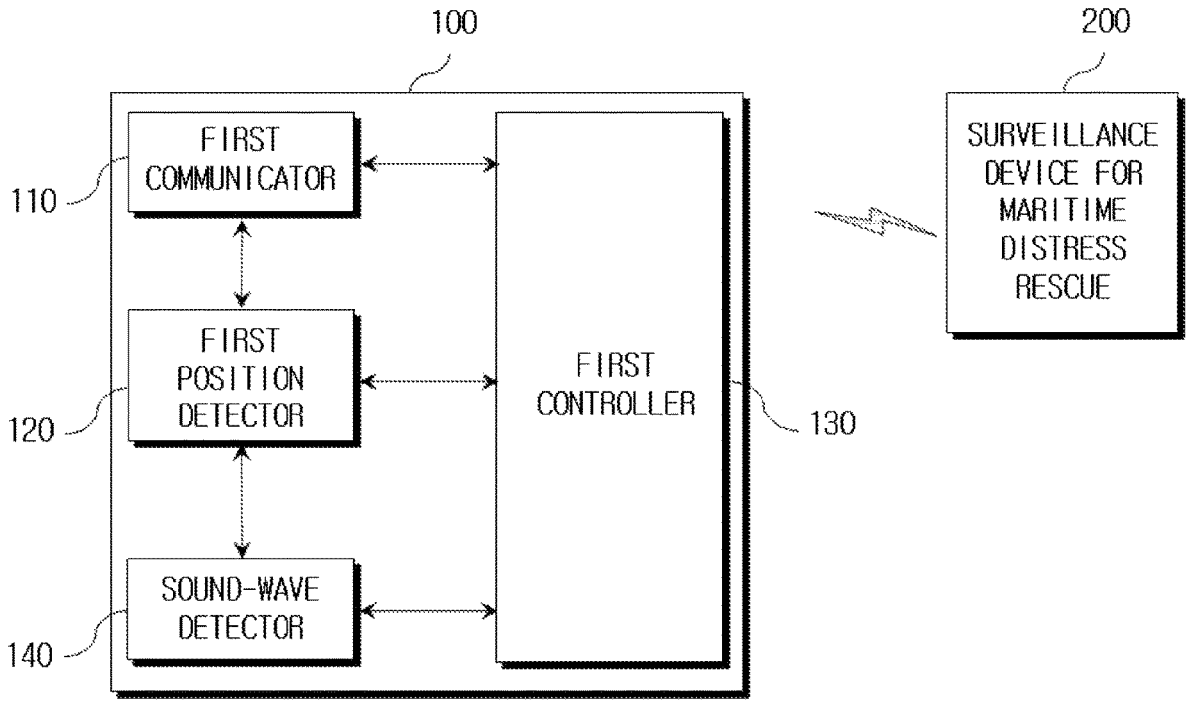
FIG. 2 is a diagram illustrating a configuration of a signal device for maritime distress rescue according to one embodiment of the present invention.

FIG. 2 is a diagram illustrating a configuration of a signal device for maritime distress rescue according to one embodiment of the present invention.

Referring to FIG. 2, the signal device 100 for maritime distress rescue may include a first communicator 110, a first position first position detector 120, and a first controller 130.

The first communicator 100 communicates with a surveillance device 200 for maritime distress rescue in a ship. For example, the first communicator 110 may perform at least one of RF communication, Bluetooth communication, and network communication. The first communicator 110 receives second position information from the surveillance device 200. Here, the second position information refers to position information which includes GPS coordinates, azimuth, moving speed, and moving direction of the surveillance device 200. The first communicator 110 and periodically receives the second position information while operating in reception mode or sleep mode. In the reception mode or sleep mode, the first communicator 110 is operated at minimum power. In a distress situation, the first communicator 110 is switched to high-power transmission mode and transmits first position information to the surveillance device 200. Here, the first position information refers to position information that includes GPS coordinates, azimuth, moving speed, and moving direction of the signal device 100.

In addition, the first communicator 110 may communicate with a first user terminal. The user terminal is a portable terminal used by the user of the signal device 100. The first communicator 110 may receive second position information from the first user terminal. This is for comparing the second position information received from the surveillance device 200 installed in the ship with the second position information received from the first user terminal. The first communicator 110 may receive first position information from the first user terminal. In this case, the first user terminal may transmit the first position information received from the first communicator 110 to the signal device 100. Accordingly, the signal device 100 and the surveillance device 200 are allowed to exchange the position information using the first user terminal when a communication therebetween is unstable.

The first position first position detector 120 generates position information using a GPS module. The first position first position detector 120 generates the first position information at a predetermined time interval. The first position information is temporarily stored, updated at a predetermined time interval, and output to the first controller 130. The first position information and the second position information may include marine GPS coordinate information, height information, speed information, moving direction information, and position generation time information. The first position first position detector 120 may change a generation interval of the first position information according to a time interval of the second position information received from the surveillance device 200.

The first controller 130 controls the driving of the first communicator 110 and the first position first position detector 120. For example, the first controller 130 stores the second position information received from the first communicator 110. The first controller 130 controls the first position first position detector 120 to generate the first position information at the predetermined time interval and compares the first position information with the second position information. The first controller 130 determines whether or not the first position information related to the position of the signal device 100 is within a predetermined safe area by comparing the first position information and the second position information. Here, the safe area may be pre-set on the basis of the second position information and be set in a shape of a circle, an ellipse, or a vessel-like polygon. The safe area is a type of a geofence, and it may be preferable to store a value preset according to a size and type of the vessel.

In addition, the first controller 130 determines whether or not the first position information is within the safe area. For example, when the first position information is within the safe area, the first controller 130 controls the first communicator 110 to wait in reception mode or sleep mode. By doing so, it is possible to prevent the first communicator 110 from being switched to transmission mode, thereby reducing power consumption due to high-power communication and maximizing the driving time. When the first position information is out of the safe area, the first controller 130 outputs a distress signal to the surveillance device 200 by switching the first communicator 110 to high-power transmission mode. Here, the distress signal may contain information, such as the first position information and the ID. The first communicator 110 may emit the distress signal at predetermined time intervals, thereby allowing the surveillance device 200 to be notified of the distress signal, and the first communicator 110 is capable of long-distance communication.

In addition, when the vessel is stationary, the first controller 130 may reset coordinates of the safe area using azimuth of the vessel as heading information and map the first position information thereto. Here, the azimuth refers to a direction of the bow of the vessel with respect to north. For example, when the vessel is stationary, the first controller 130 cannot obtain moving direction information of the vessel from GPS coordinates because the speed of the vessel is zero, but it is possible to determine a direction of the bow of the vessel using a geomagnetic first position detector. Thus, whether the distress signal is generated is determined by moving the safe area according to the north-based azimuth and mapping the first position information thereto.

In addition, when the vessel is moving, the first controller 130 may identify the speed and information reception time of the vessel from the second position information and correct coordinates of the safe area or coordinates of the first position information. For example, in a case in which the second position information is generated at time t1 and the first position information is generated at time t2, a correction distance may be generated by reflecting a difference in generation time between the first and second position information in the speed of the vessel. In this case, whether a distress situation has occurred is determined by correcting the coordinates of the safe area by the correction distance or correcting and mapping the coordinates of the first position information. This is to reduce an error by resetting the coordinates of the safe area or the first position information by taking into consideration the distance or direction in which the vessel is moved while the signal device 100 for maritime distress rescue receives the second position information from the surveillance device 200 for maritime distress rescue.

In addition, the first controller 130 may calculate a speed difference between the first position information and the second position information and determine whether or not the difference is within a predetermined range. When the speed difference between the first position information and the second position information is within the predetermined range, the first controller 130 controls the first communicator 110 to wait in reception mode or sleep mode. When the speed difference between the first position information and the second position information exceeds the predetermined range, the first controller 130 switches the mode of the first communicator 110 to high-power transmission mode and outputs a distress signal to the surveillance device 200. Accordingly, it is possible to more accurately determine a distress situation using the speed difference between the first position information and the second position information. Even when it is determined that the first position information is within the safe area, if the speed difference between the first position information and the second position information is out of an allowable error range, the first controller 130 re-corrects the safe area, or determines the distress situation and outputs a distress signal.

In addition, the first controller 130 may calculate a height difference between the first position information and the second position information and determine whether or not the height difference is within a predetermined range. When the height difference between the first position information and the second position information is within the predetermined range, the first controller 130 controls the first communicator 110 to wait in reception mode or sleep mode. Even when it is determined that the first position information is within the safe area, if the height difference between the first position information and the second position information is out of the predetermined range, the first controller 130 re-corrects the safe area, or determines a distress situation and outputs a distress signal. Accordingly, it is possible to more accurately determine a distress situation using the height difference between the first position information and the second position information. It may be preferable to use such a height difference for a vessel having a height greater than a predetermined height.

Meanwhile, the signal device 100 for maritime distress rescue according to one embodiment of the present invention may further include a sound-wave detector 140. The sound-wave detector 140 detects surrounding sound waves. The sound-wave detector 140 may detect an audible frequency (approximately 20 to 20,000 Hz) and an ultrasonic wave as a sound wave. When the sound-wave detector 140 detects a predetermined audible frequency, the sound-wave detector 140 outputs sound-wave information to the first controller 130. The sound-wave information may increase the accuracy related to a distress signal. For example, in a case where a user away from the vessel is in distress, the user's screaming may be detected.

In this case, the first controller 130 may primarily determine whether the first position information and the second position information are within the safe area and secondarily determine whether sound-wave information is received. For example, when the first position information and the second position information are out of a predetermined safe area and the sound-wave information greater than a predetermined frequency is received, a distress signal may be output. In addition, a distress signal may be output by comparing the first position information and the second position information, and when the sound-wave information is detected within a predetermined period of time, an additional distress signal may be output. This is to increase the accuracy of the distress signal by detecting a voice signal of a person in distress requesting a rescue at the early stage of distress.

Figure 3:
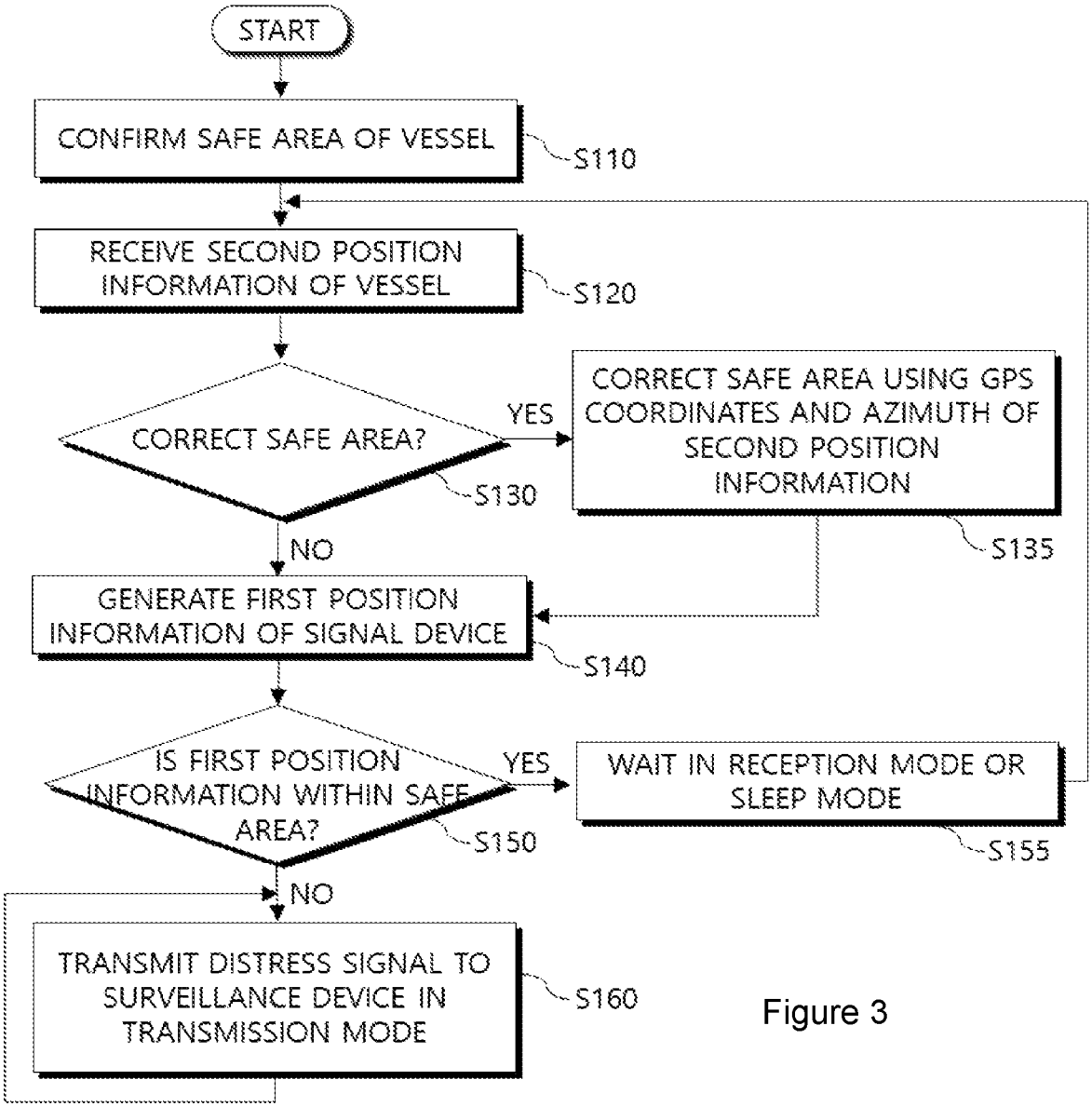
FIG. 3 is an operation flowchart of the signal device for maritime distress rescue in accordance with FIG. 2.

FIG. 3 is an operation flowchart of the signal device for maritime distress rescue in accordance with FIG. 2.

Referring to FIG. 3, the signal device for maritime distress rescue confirms a predetermined safe area of a vessel (S110). Then, the signal device receives second position information from a surveillance device for maritime distress rescue (S120). In this case, the second position information includes GPS coordinates, geomagnetic information, moving speed, moving direction, and the like, and is stored in the signal device. Whether the safe area is to be corrected is determined using heading information, moving speed, and moving direction in the second position information (S130). When the safe area is to be corrected, the predetermined safe area is corrected according of the heading information, moving speed, and moving direction of the vessel (S135). Then, first position information of the signal device for maritime distress rescue is generated (S140). The first position information may include GPS coordinates, geomagnetic information, moving speed, moving direction, and the like of the signal device. Then, whether or not the first position information is within the safe area is determined (S150). When the first position information is within the safe area, the signal device for maritime distress rescue waits in reception mode or sleep mode, and receives the second position information (S155). When the first position information is not within the safe area, the mode of the signal device is switched to high-power transmission mode and a high-power distress signal is transmitted to the surveillance device for maritime distress rescue (S160). In this case, the distress signal is continuously output at a predetermined time interval, thereby allowing the surveillance device to receive the distress signal.

Figure 4:
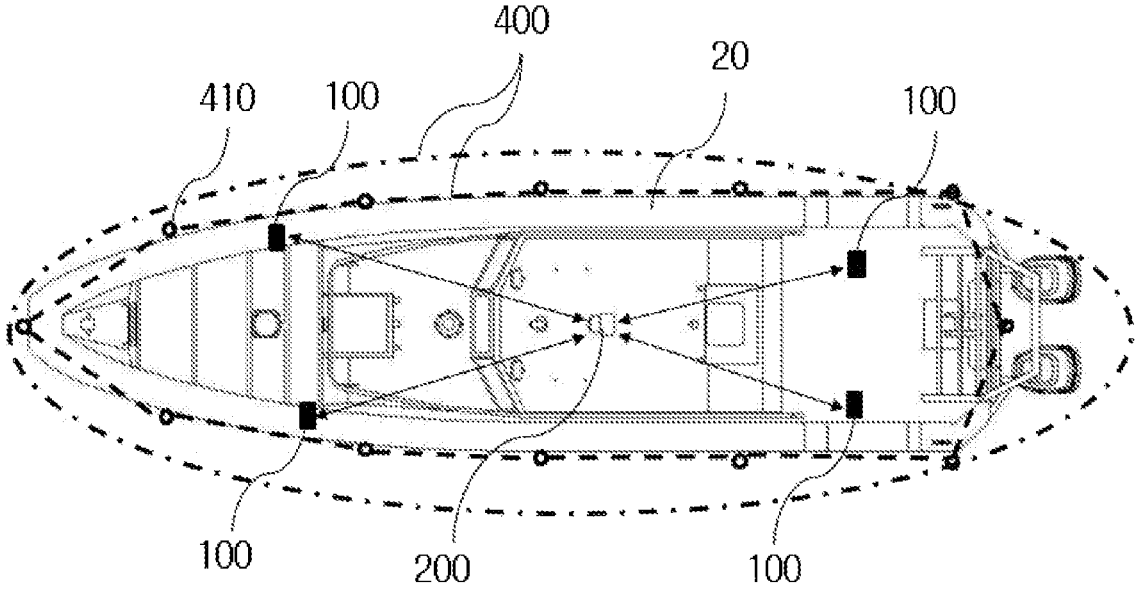
FIG. 4 is a diagram for describing an example in which the signal device of FIG. 2 determines a safe area.
Figure 5:
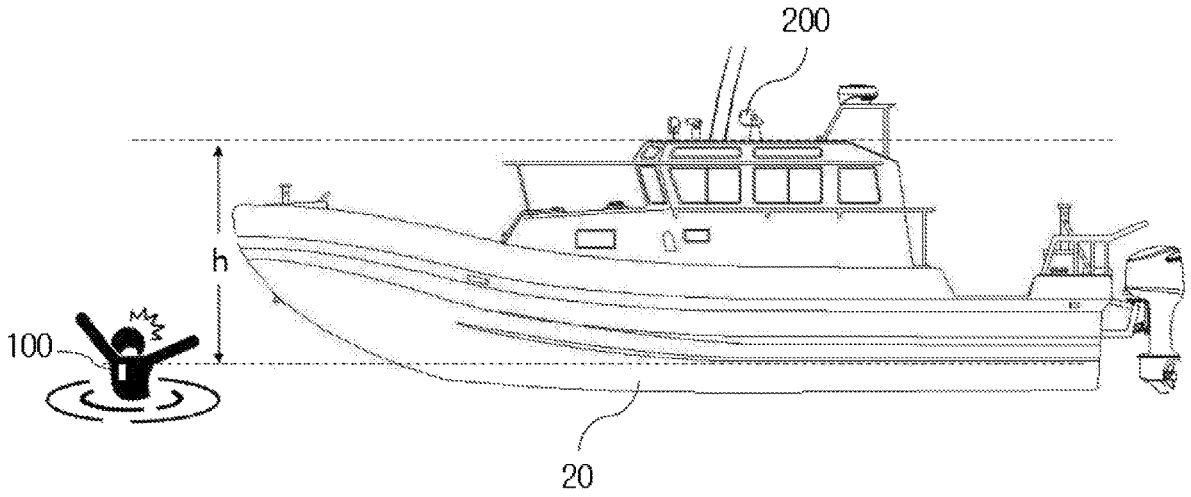
FIG. 5 is a diagram for describing an example in which the signal device of FIG. 2 determines a height difference.

FIG. 4 is a diagram for describing an example in which the signal device of FIG. 2 determines a safe area, and FIG. 5 is a diagram for describing an example in which the signal device of FIG. 2 determines a height difference.

Referring to FIG. 4, a safe area 400 for a vessel may be set in a shape of a circle, an ellipse, or a polygon on the basis of second position information of a surveillance device 200 for maritime distress rescue. The surveillance device 200 may transmit the second position information by including the safe area 400 therein. At least one signal device 100 for maritime distress rescue may confirm the predetermined safe area 400 or correct the safe area 400 using the second position information. In addition, the signal device 100 may obtain the safe area 400 in a polygonal shape similar to the shape of the vessel using a plurality of position first position detectors 410 attached to the vessel. The safe area 400 may be preferably set in advance according to the model of the vessel.

Referring to FIG. 5, whether a distress signal is to be transmitted may be determined by comparing height information h between the signal device 100 for maritime distress rescue and the surveillance device 200 for maritime distress rescue. The signal device 100 compares height information h between first position information, which is related to the position of the signal device 100, and the second position information of the surveillance device 200 and determines whether a difference is within an allowable range. In this case, the height information h may be determined based on information on a position at which a GPS antenna is installed, ceiling height information of the vessel, and deck height information of the vessel. The signal device 100 may re-set the safe area or output a distress signal when the height difference exceeds a predetermined value.

Figure 6:
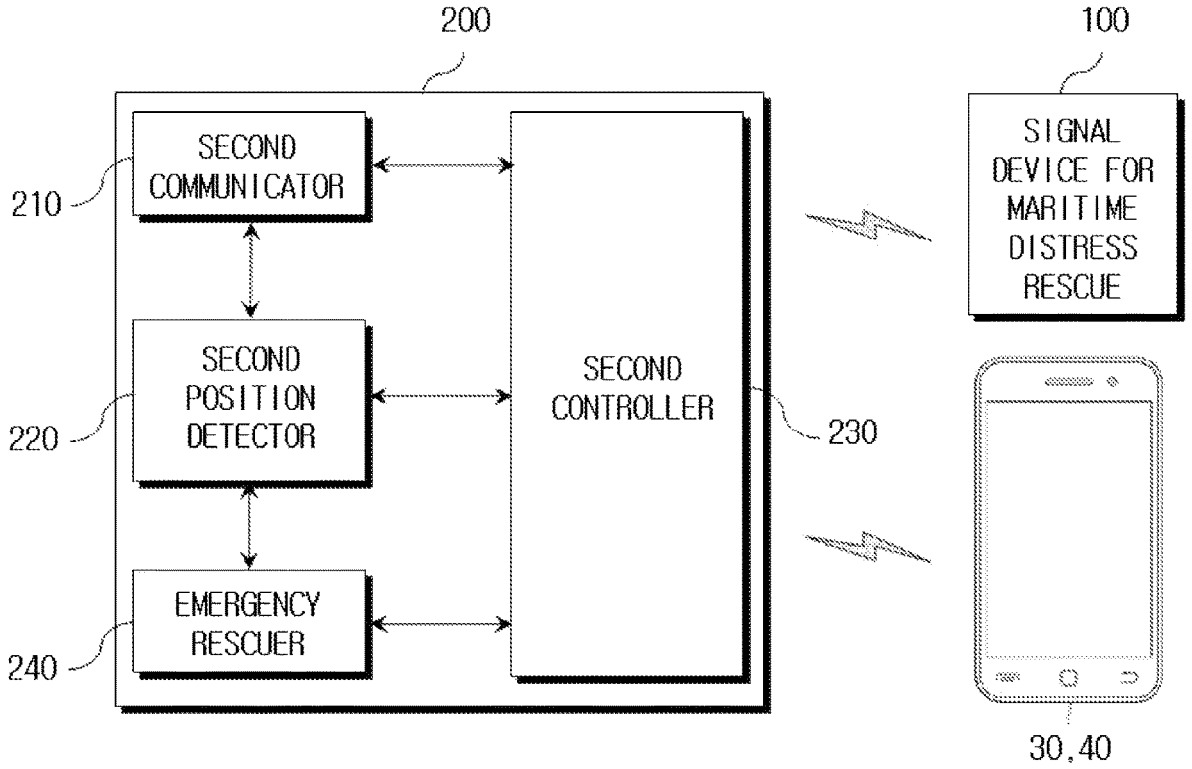
FIG. 6 is a diagram illustrating a configuration of a surveillance device for maritime distress rescue according to one embodiment of the present invention.

FIG. 6 is a diagram illustrating a configuration of a surveillance device for maritime distress rescue according to one embodiment of the present invention.

Referring to FIG. 6, the surveillance device 200 for maritime distress rescue includes a second communicator 210, a second position detector 220, and a second controller 230.

The second communicator 210 communicates with a signal device 100 for maritime distress rescue in a vessel. For example, the second communicator 210 may perform at least one of RF communication, Bluetooth communication, and network communication. The second communicator 210 transmits second position information to the signal device 100 for maritime distress rescue. Here, the second position information refers to position information of the surveillance device 200. The second communicator 210 periodically transmits the second position information. The second communicator 210 receives a distress signal that is transmitted from a first communicator 110 that has switched from reception mode or sleep mode to transmission mode. In this case, the distress signal includes first position information. Here, the first position information refers to position information which includes GPS coordinates, azimuth, moving direction, and moving direction of the signal device 100.

In addition, the second communicator 210 may communicate with a first user terminal 20 or a second user terminal 40. The first user terminal 30 is a portable terminal used by a user of the signal device 100 and the second user terminal 40 is a portable terminal used by a user of the surveillance device 200. In this case, the first user terminal 30 and the second user terminal 40 may preferably have an application for maritime distress rescue installed therein. The second communicator 210 may transmit the first position information to the first user terminal 30 or receive the second position information from the first user terminal 30. By doing so, when the signal device 100 installed in the vessel is located far from the surveillance device 200, the first position information or a distress signal may be transmitted over a network through the first user terminal 30.

In addition, the second communicator 210 may transmit the distress signal to the second user terminal 40. The second communicator 210 transmits the distress signal to the second user terminal 40 so that the user performs a rescue operation using the distress signal while moving to a distress site. In this case, when the distress signal is updated, it is preferable to update the distress signal in the second user terminal 40 in synchronization with the updated distress signal. The second communicator 210 may establish a connection with the second user terminal 40 using RF communication, Bluetooth communication, or network communication. Accordingly, a rescuer in the vessel may swiftly rescue a person in distress at the site using the second user terminal 40.

The second position detector 220 generates position information using a GPS module. The second position detector 220 generates the second position information at a predetermined time interval. The second position information is updated at a predetermined time interval. The second position information may include marine GPS coordinate information, height information, speed information, moving direction information, and azimuth information. The moving direction information of the vessel may be calculated from heading information received from a GPS or geomagnetic information.

In addition, when the vessel is stationary, the second position detector 220 generates the second position information including GPS coordinates of the surveillance device 200 and heading information related to azimuth of the vessel. This is because the moving speed or moving direction cannot be obtained from the GPS information when the vessel is stationary. When the vessel is moving, the second position detector 220 generates the second position information that includes at least one of GPS coordinates, moving direction, and moving speed of the surveillance device 200.

The second controller 230 controls the driving of the second communicator 210 and the second position detector 220. For example, the second controller 230 transmits the second position information to the signal device 100 through the second communicator 210 at a predetermined time interval. In this case, coordinates of the safe area of the vessel may be pre-set in the signal device 100 for maritime distress rescue, and the coordinates of the safe area may be transmitted together with the second position information through the second controller 230. Here, the safe area may be pre-set on the basis of coordinates of the vessel on a plane and be set in a shape of a circle, an ellipse, or a vessel-like polygon. The safe area may be set using geofencing technology.

In addition, when the distress signal is received from the signal device 100 for maritime distress rescue, the second controller 230 may predict a location of the person in distress on the basis of the second position information included in the distress signal and sea current information of the surrounding sea. In this case, the second controller 230 may predict the location of the person in distress and control the speed or direction of the vessel. When a further distress signal is not received after the distress signal has been received, the second controller 230 may generate predicted location information of the person in distress and transmit the predicted location information to the first user terminal 30 or the second user terminal 40.

In addition, the second controller 230 may transmit a request signal to the signal device 100 at a predetermined time interval. Here, the request signal is a signal requesting to transmit first position information of a plurality of signal devices 100. When the second controller 230 receives the distress signal, the second controller 230 may transmit the distress signal and an alarm signal to the signal device 100 of the user within a predetermined range. This is to transmit the alarm signal to an administrator or general user closest to the person in distress in a case of a large vessel so that emergency rescue can be carried out. In this case, the second controller 230 may provide first position information or predicted location information of the person in distress to the first user terminal 30 or the second user terminal 40.

In addition, when the distress signal is received from the signal device 100, the second controller 230 may display whether or not a plurality of users aboard the vessel are in distress. In this case, the second controller 230 may output distress information to a display in map mode in which the first position information and the second position information are mapped to an electronic map, or in compass mode in which a distance and azimuth between the signal device 100 and the surveillance device 200. By doing so, an administrator of the surveillance device 200 may intuitively and quickly confirm the location of the person in distress.

Meanwhile, the surveillance device 200 for maritime distress rescue may further include an emergency rescuer 240. The emergency rescuer 240 moves an unmanned drone to the location of the person in distress on the basis of the distress signal and predicted location information. The emergency rescuer 240 may control the speed, location, direction, and the like of the unmanned drone. The emergency rescuer 240 may early acquire an image of the person in distress by obtaining image information from the unmanned drone. The emergency rescuer 240 may guide a direction of a rescue ship or rescue helicopter dispatched by a control center by controlling the formation flight of a plurality of unmanned drones. The emergency rescuer 240 acquires movement information of the person in distress by analyzing images of the surroundings on the basis of the predicted location information. The emergency rescuer 240 may control flight time according to the remaining battery power of the unmanned drone. The emergency rescuer 240 may send an emergency relief item to the predicted location information through the unmanned drone. In this case, the unmanned drone may be configured in the form of a flying drone or underwater drone. The unmanned drone may serve as a type of a repeater and may be used to expand the communication range of the person in distress.

Figure 7:
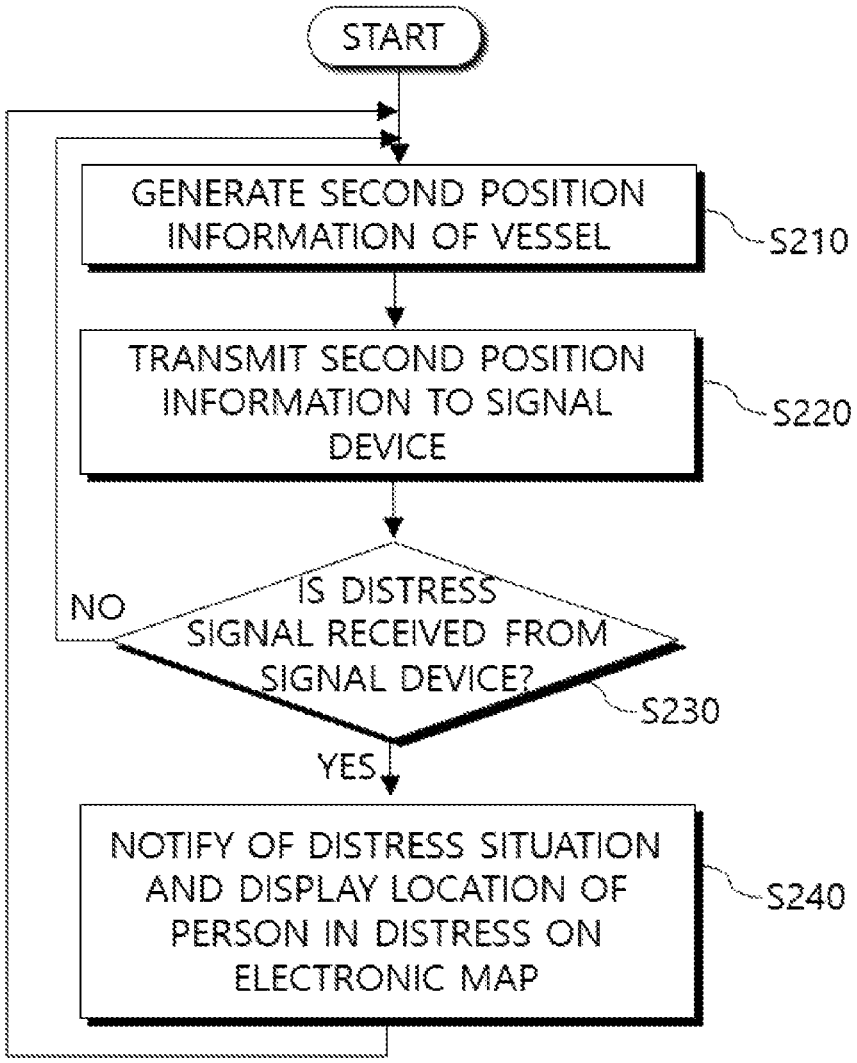
FIG. 7 is an operation flowchart of the surveillance device for maritime distress rescue in accordance with FIG. 6.

FIG. 7 is an operation flowchart of the surveillance device for maritime distress rescue in accordance with FIG. 6.

Referring to FIG. 7, the surveillance device for maritime distress rescue generates second position information of a vessel (S210). The second position information includes GPS coordinates, azimuth, moving direction, and moving speed. Then, the second position information is transmitted to a signal device for maritime distress rescue (S220). In this case, the second position information may be transmitted to the signal device at a predetermined time interval. Then, whether or not a distress signal is received from the signal device is determined (S230). The distress signal includes an ID of the signal device, first position information, transmission time, and the like. When the distress signal is received from the signal device, a distress situation is notified and a location of a person in distress is displayed on an electronic map (S240). In this case, distress information may be output to a display and an alarm sound may be output through a speaker. When the distress signal is not received from the signal device, operation S210 and the following operations are performed again.

Figure 8:
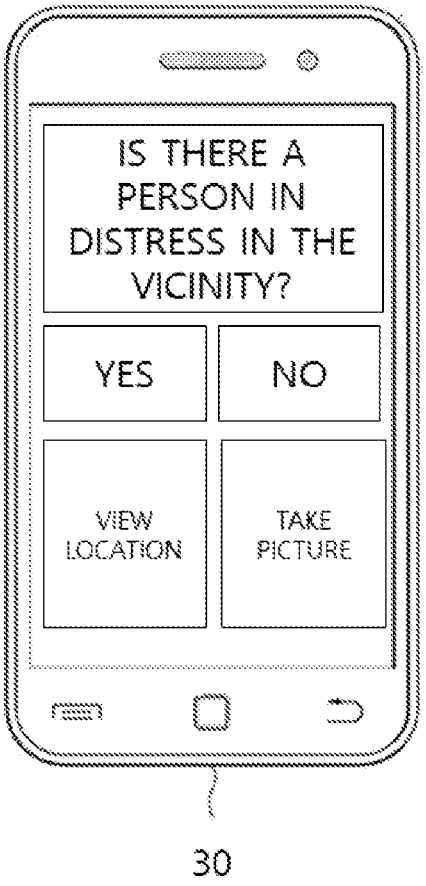
FIG. 8 is a diagram for describing an example in which the surveillance device for maritime distress rescue in accordance with FIG. 6 communicates with a first user terminal.

FIG. 8 is a diagram for describing an example in which the surveillance device for maritime distress rescue in accordance with FIG. 6 communicates with a first user terminal.

Referring to FIG. 8, the surveillance device 200 for maritime distress rescue may communicate with the first user terminal 30. The first user terminal 30 may receive a distress signal from the surveillance device 200. The first user terminal 30 may confirm position information or capture an image in order to check a person in distress in the vicinity. When the person in distress in the vicinity is confirmed through the first user terminal 30, a confirmation signal is transmitted to the surveillance device 200. Accordingly, in the case where a distress signal is generated, information on the site may be immediately confirmed using the first user terminals 30 of users of a plurality of signal devices 100 for maritime distress rescue. In this case, it is preferable to install an application connected to the surveillance device 200 in the first user terminal 30.

In addition, the first user terminal 30 may receive a distress signal from the signal device 100 of the person in distress. This is to allow the first user terminal 30 to relay the distress signal to the surveillance device 200 in addition to the distress signal being received by the surveillance device 200. Accordingly, a plurality of first user terminals 30 serve as relay stations so that the distress signal can be more accurately and promptly transmitted to the surveillance device 200.

Figure 9:
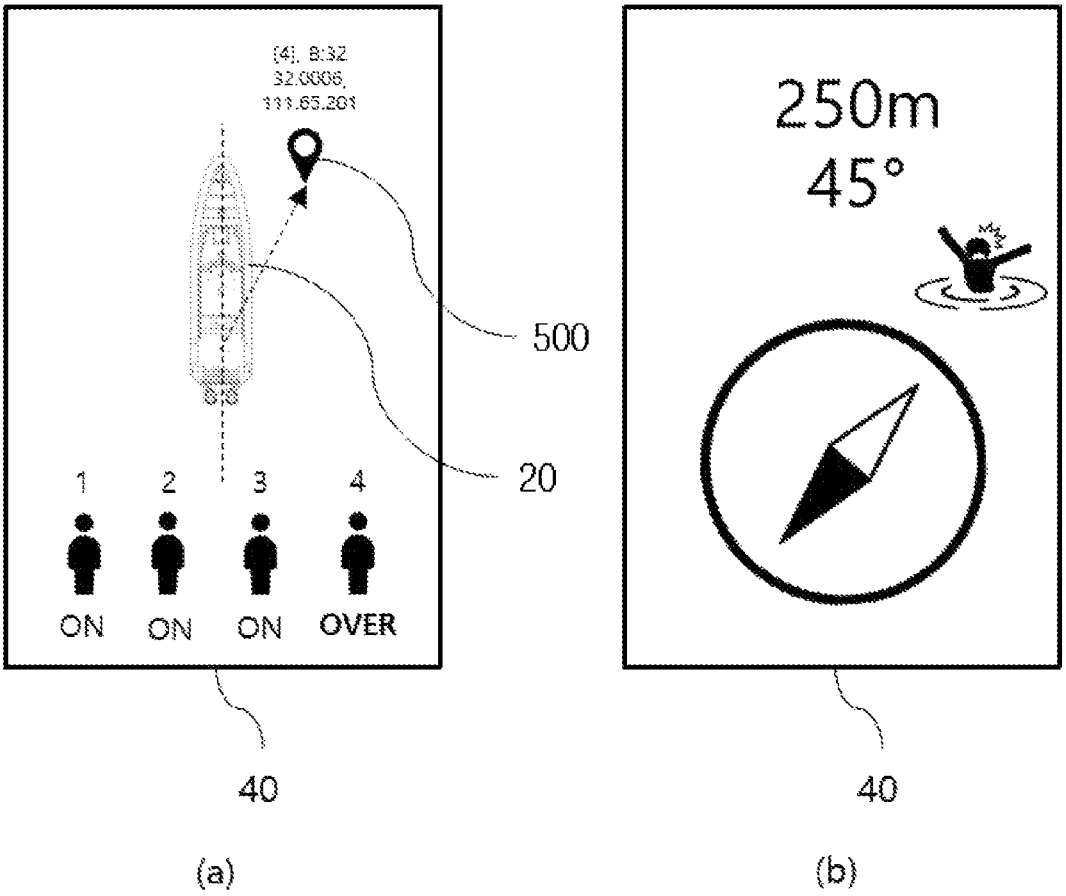
FIG. 9 is a diagram for describing an example in which the surveillance device of FIG. 6 for maritime distress rescue locates a position of a person in distress.

FIG. 9 is a diagram for describing an example in which the surveillance device of FIG. 6 for maritime distress rescue locates a position of a person in distress.

FIG. 9(A) illustrates that information on a person in distress is displayed in map mode on a display of the second user terminal 40, and FIG. 9(B) illustrates that information on a person in distress is displayed in compass mode on the second user terminal 40. Predicted location information 500 related to the person in distress is output as coordinate data, together with an icon, to the display of the second user terminal 40. The second user terminal 40 provides the predicted location information 500 together with the icon of the vessel, so that the location of the person in distress can be easily identified. For example, when a user of the second user terminal 40 has found a person in distress, the user may transmit discovery information to the surveillance device for maritime distress rescue. In this case, the information on the person in distress may be displayed as the same screen on the surveillance device and the display of the second user terminal 40.

In addition, emergency rescue signals of the maritime police or navy may be requested by utilizing a communication network of the surveillance device. By doing so, users at various positions in the vessel are allowed to confirm the location of the person in distress and thereby swiftly performing a rescue operation. In this case, the surveillance device for maritime distress rescue may transmit the predicted location information 500 to the first user terminal in addition to the second user terminal 40.

Also, as shown in FIG. 9(B), in compass mode, a distance between the signal device for maritime distress rescue and the surveillance device for maritime distress rescue may be calculated using GPS coordinates of first position information and second position information and the azimuth of the first position information and the azimuth of the second position information may be compared to display the current predicted location information of the person in distress as a distance and an angle. In this case, the surveillance device for maritime distress rescue may turn the bow of the vessel toward the person in distress on the basis of the current heading information and rescue the person along a path with the shortest distance.

Accordingly, a distress situation of a mariner aboard a vessel may be accurately detected and an alarm notification may be issued, without an operation of a flooding detection first position detector or a switch, while minimizing power consumption of the signal device for maritime distress rescue supplied with power from a battery, so that a rescue operation for a person in distress can be swiftly carried out and a precise location of the person in distress can be transmitted using GPS information.

In addition, it is possible to more accurately determine whether a distress has occurred by utilizing digital data, such as a safe area, height information or speed information of the vessel.

In addition, the location of the person in distress may be predicted and transmitted to the user terminal, so that prompt rescue can be carried out with the help of any vessels or authorities near the person in distress.

A number of examples have been described above. Nevertheless, it will be understood that various modifications may be made. For example, suitable results may be achieved if the described techniques are performed in a different order and/or if components in a described system, architecture, device, or circuit are combined in a different manner and/or replaced or supplemented by other components or their equivalents. Accordingly, other implementations are within the scope of the following claims.

What is claimed is:

1. A surveillance device for maritime distress rescue which is mounted in a vessel, the surveillance device comprising:

a second communicator configured to communicate a signal device for maritime distress rescue which is carried by a user aboard the vessel;

a second position detector configured to generate second position information including current GPS coordinates of the surveillance device and heading information of the vessel at a predetermined time interval; and a second controller configured to transmit the second position information to the signal device at a predetermined time interval and determine whether a distress signal is received from the signal device, wherein the distress signal is transmitted only when it is determined that first position information of the signal device is out of a safe area which is set on the basis of the second position information; and wherein the second position detector is configured to, when the vessel is stationary, generate the second position information including the GPS coordinates of the surveillance device and heading information, which is azimuth of the vessel, and, when the vessel is moving, generate the second position information including at least one of the GPS coordinates, moving direction, and moving speed of the surveillance device.

2. The surveillance device of claim 1, wherein, when the distress signal is received, the second controller is configured to display on a display whether a plurality of users aboard the vessel are in distress, wherein whether the plurality of users aboard the vessel are in distress is displayed in map mode in which the first position information and the second position information are mapped on an electronic map, or in compass mode in which a distance and azimuth between the signal device and the surveillance device are displayed.

* * * * *